US009761981B2

(12) United States Patent
Oyake

(10) Patent No.: US 9,761,981 B2
(45) Date of Patent: Sep. 12, 2017

(54) CONNECTOR INCLUDING A GROUND MEMBER WITH A LOCK SPRING TO LOCK A PORTION OF A MATING CONNECTOR

(71) Applicant: JAPAN AVIATION ELECTRONICS INDUSTRY, LIMITED, Shibuya-ku, Tokyo (JP)

(72) Inventor: Takayoshi Oyake, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/126,993

(22) PCT Filed: Mar. 2, 2015

(86) PCT No.: PCT/JP2015/056034
§ 371 (c)(1),
(2) Date: Sep. 16, 2016

(87) PCT Pub. No.: WO2015/141452
PCT Pub. Date: Sep. 24, 2015

(65) Prior Publication Data

US 2017/0110821 A1 Apr. 20, 2017

(30) Foreign Application Priority Data

Mar. 19, 2014 (JP) ..... 2014-056055

(51) Int. Cl.
*H01R 13/648* (2006.01)
*H01R 13/405* (2006.01)
(Continued)

(52) U.S. Cl.
CPC ..... *H01R 13/405* (2013.01); *H01R 13/6275* (2013.01); *H01R 13/6581* (2013.01); *H01R 13/6585* (2013.01)

(58) Field of Classification Search
CPC .... H01R 13/28; H01R 13/648; H01R 13/658; H01R 13/6585; H01R 13/6586;
(Continued)

(56) References Cited

U.S. PATENT DOCUMENTS 4,824,383 A * 4/1989 Lemke ..... H01R 24/60 439/108
5,057,028 A * 10/1991 Lemke ..... H01R 23/688 439/101
(Continued)

FOREIGN PATENT DOCUMENTS

CN 100459306 C 2/2009
CN 202712613 U 1/2013
(Continued)

OTHER PUBLICATIONS

International Search Report (ISR) and Written Opinion dated Apr. 14, 2015 issued in International Application No. PCT/JP2015/056034.
(Continued)

*Primary Examiner* — Chandrika Prasad
(74) *Attorney, Agent, or Firm* — Holtz, Holtz & Volek PC

(57) ABSTRACT

A connector, which can mate with an opposing connector in a mating direction, is provided with a first alignment member, a second alignment member, a plurality of first contacts, a plurality of second contacts, a ground member, and a holding member. The first alignment member aligns the first contacts in a pitch direction, and the second alignment member aligns the second contacts in said pitch direction. The ground member has a main section, a locking spring section, and a connecting section. The locking spring section has a locking part that locks to a locking-target part on the opposing connector. The connecting section connects the main section to the locking spring section. The holding member holds the first alignment member, the second align-
(Continued)

ment member, and the ground member together such that the main section of the ground member is positioned between the first alignment member and the second alignment member.

16 Claims, 8 Drawing Sheets

(51) Int. Cl.
*H01R 13/6585* (2011.01)
*H01R 13/6581* (2011.01)
*H01R 13/627* (2006.01)

(58) Field of Classification Search
CPC .... H01R 13/688; H01R 13/613; H01R 24/60; H01R 29/00; H01R 4/64; H01R 13/41; H01R 13/405; H01R 13/6275; H01R 13/6315; H01R 23/725
USPC ..... 439/248, 607.05, 607.06, 109
See application file for complete search history.

(56) References Cited

U.S. PATENT DOCUMENTS

| | | | | |
|---|---|---|---|---|
| 5,169,324 | A * | 12/1992 | Lemke | H01R 13/187 439/101 |
| 7,150,634 | B2 | 12/2006 | Kato et al. | |
| 8,262,411 | B2 * | 9/2012 | Kondo | H01R 13/6658 439/607.01 |
| 9,450,337 | B2 * | 9/2016 | Kao | H01R 13/6461 |
| 2005/0287847 | A1 | 12/2005 | Kato et al. | |
| 2013/0065454 | A1 | 3/2013 | Milbrand | |
| 2016/0064864 | A1 * | 3/2016 | Kao | H01R 13/6461 439/607.05 |
| 2016/0079714 | A1 * | 3/2016 | Wu | H01R 13/6585 439/607.05 |
| 2016/0141817 | A1 * | 5/2016 | Wu | H01R 24/60 439/676 |
| 2016/0172791 | A1 * | 6/2016 | Fan | H01R 13/6585 439/607.05 |
| 2016/0380387 | A1 * | 12/2016 | Wu | H01R 13/6581 439/95 |

FOREIGN PATENT DOCUMENTS

| | | | |
|---|---|---|---|
| JP | 03501185 | A | 3/1991 |
| JP | 2000252018 | A | 9/2000 |
| JP | 2002367732 | A | 12/2002 |
| JP | 2005327701 | A | 11/2005 |
| JP | 2008146954 | A | 6/2008 |
| WO | 2009147791 | A1 | 12/2009 |

OTHER PUBLICATIONS

Chinese Office Action (and English translation thereof) dated Jun. 2, 2017 issued in counterpart Chinese Application No. 201580013838.7.

* cited by examiner

CONNECTOR INCLUDING A GROUND MEMBER WITH A LOCK SPRING TO LOCK A PORTION OF A MATING CONNECTOR

TECHNICAL FIELD

This invention relates to a connector comprising a lock portion which is to lock a locked portion of a mating connector.

BACKGROUND ART

Referring to FIGS. 11 to 13, a connector 900 of Patent Document 1 comprises a plurality of contacts 910, a holding member 920 holding the contacts, a ground plate 930, a shell 940 and lock members 950. The contacts 910 are arranged in two rows. The ground plate 930 is positioned between the rows of the contacts 910. The ground plate 930 is formed with spring portions 932. The contacts 910 include ground contacts 912. The spring portions 932 are connected to the ground contacts 912 in the holding member 920, respectively. Each of the lock members 950 has a lock portion 952. Each of the lock members 950 is held by the holding member 920 so that the lock portion 952 thereof is movable. The shell 940 is provided so as to cover the holding member 920. The shell 940 is formed with openings 942. The lock portions 952 pass through the openings 942, respectively, and project outward of the shell 940.

PRIOR ART DOCUMENTS

Patent Document(s)

Patent Document 1: WO2009/147791

SUMMARY OF INVENTION

Technical Problem

It is an object of the present invention to provide a connector having a structure which makes it easy to adjust a positional relation between a contact and a ground plate while suppressing increase in cost.

Solution to Problem

An aspect of the present invention provides a connector mateable with a mating connector along a mating direction. The connector comprises a first arrangement member, a second arrangement member, a plurality of first contacts, a plurality of second contacts, a ground member and a holding member. The first arrangement member arranges the first contacts in a pitch direction perpendicular to the mating direction and holds the first contacts. The second arrangement member arranges the second contacts in the pitch direction and holds the second contacts. The ground member has a flat plate-like body portion, a lock spring and a coupling portion. The lock spring has a lock portion which is to lock a locked portion of the mating connector. The coupling portion couples the body portion and the lock portion to each other. The holding member collectively holds the first arrangement member, the second arrangement member and the ground member so that the body portion of the ground member is positioned between the first arrangement member and the second arrangement member.

Advantageous Effects of Invention

The connector according to the present invention comprises three members, namely, the first arrangement member, the second arrangement member and the holding member, instead of the single holding member of Patent Document 1. However, the ground member according to the present invention integrates the body portion, which works as the ground plate of Patent Document 1, and the lock spring which works as the two lock members of Patent Document 1. Therefore, increase in number of components of the connector can be totally suppressed. As a result, extreme increase in cost can be suppressed.

Accordingly to the present invention, the first arrangement member arranges the first contacts, and the second arrangement member arranges the second contacts. Moreover, accordingly to the present invention, the holding member holds the ground member, the first arrangement member and the second arrangement member. This structure makes it easy to adjust a positional relation among the first contacts, the second contacts and the ground member.

An appreciation of the objectives of the present invention and a more complete understanding of its structure may be had by studying the following description of the preferred embodiment and by referring to the accompanying drawings.

DESCRIPTION OF EMBODIMENTS

Figure 1:
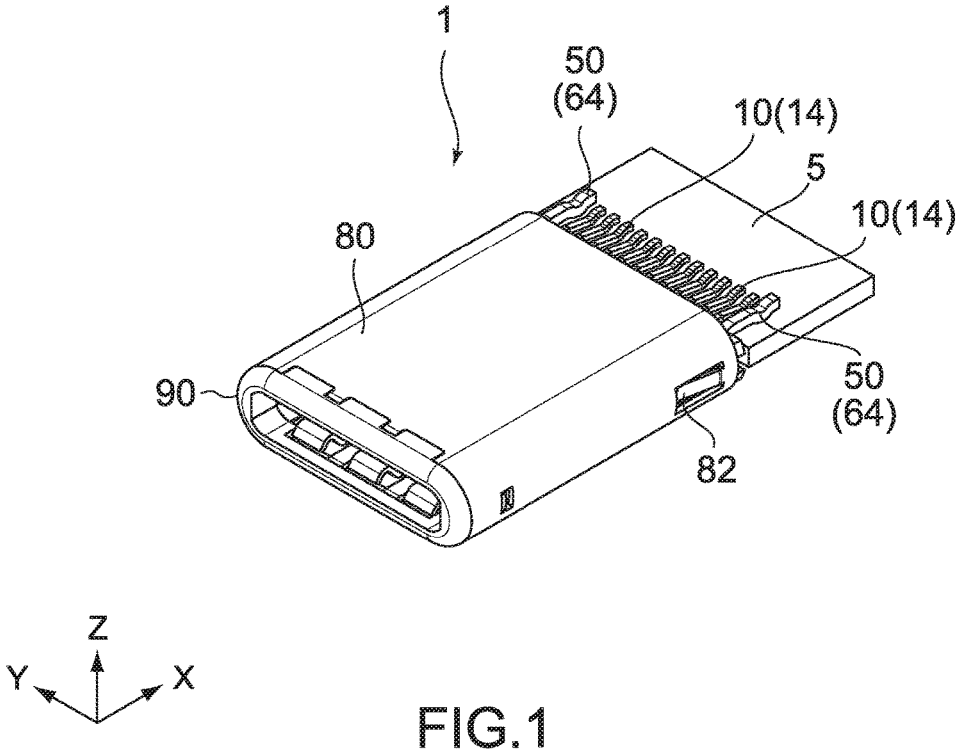
FIG. 1 is a front, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1 to 5, a connector 1 according to an embodiment of the present invention is to be connected to a cable (not shown) via a paddle board (object) 5. Moreover, the connector 1 is to be mated with a mating connector (not shown) along the X-direction (mating direction). The illustrated connector 1 comprises a plurality of first contacts 10 each made of conductor, a first arrangement member 20 made of insulator, a plurality of second contacts 30 each made of conductor, a second arrangement member 40 made of insulator, a ground member 50, a holding member 70 made of insulator, a shell 80 made of metal and a front protection member 90 made of insulator. The front protection member 90 is attached to an end, or the negative X-side end, of the shell 80 and protects the end of the shell 80.

Figure 2:
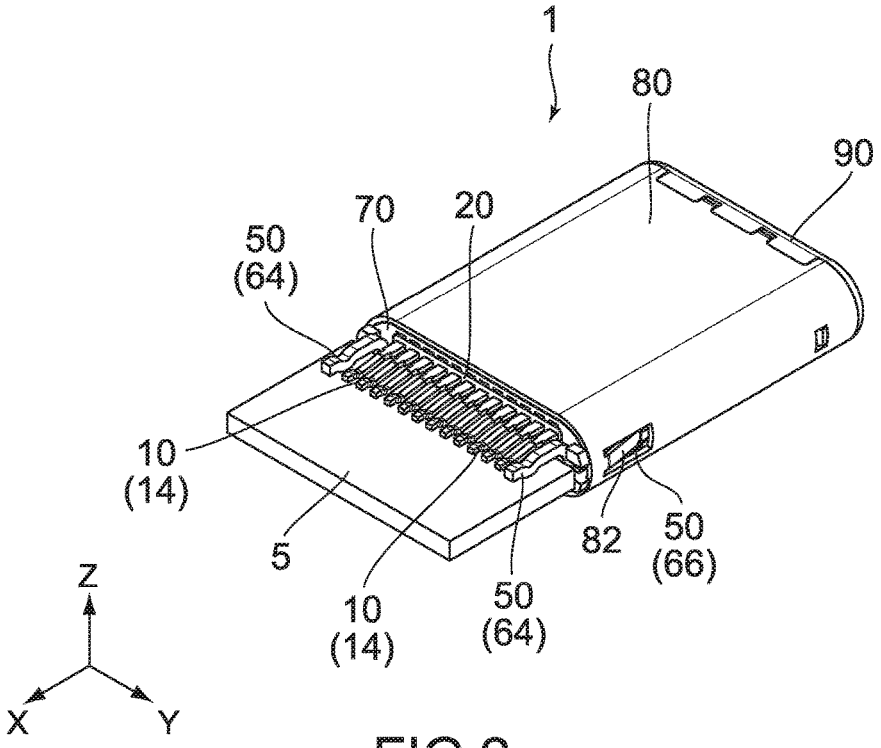
FIG. 2 is a rear, perspective view showing the connector of FIG. 1.
Figure 3:
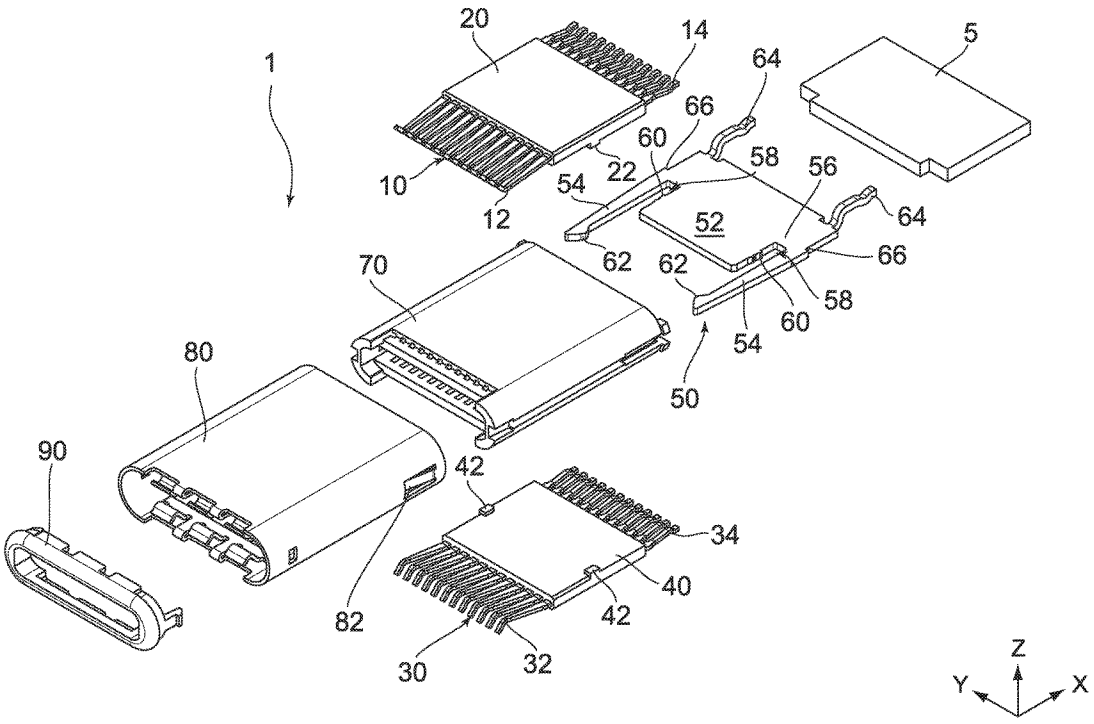
FIG. 3 is an exploded, perspective view showing the connector of FIG. 1.
Figure 4:
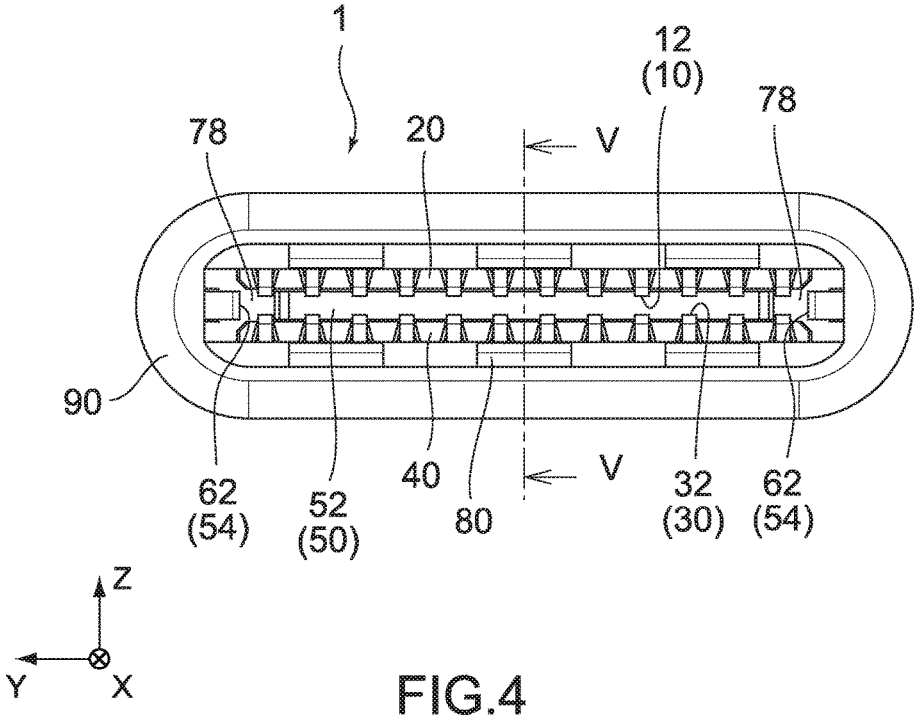
FIG. 4 is a front view showing the connector of FIG. 1.
Figure 5:
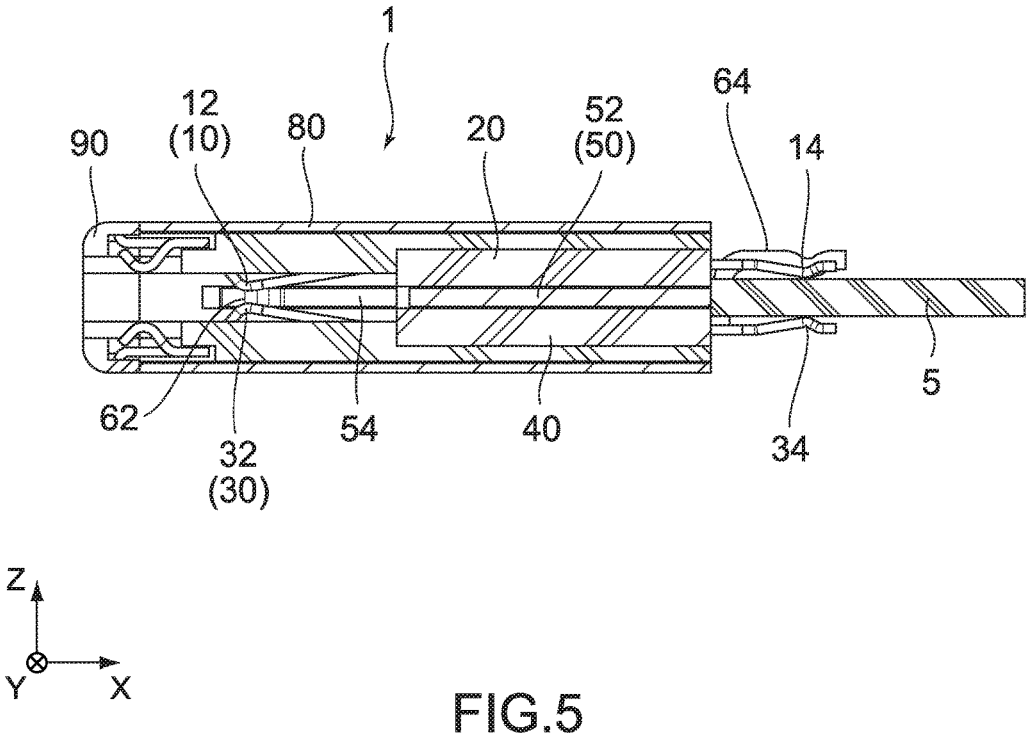
FIG. 5 is a cross-sectional view showing the connector of FIG. 4, taken along line V-V.
Figure 6:
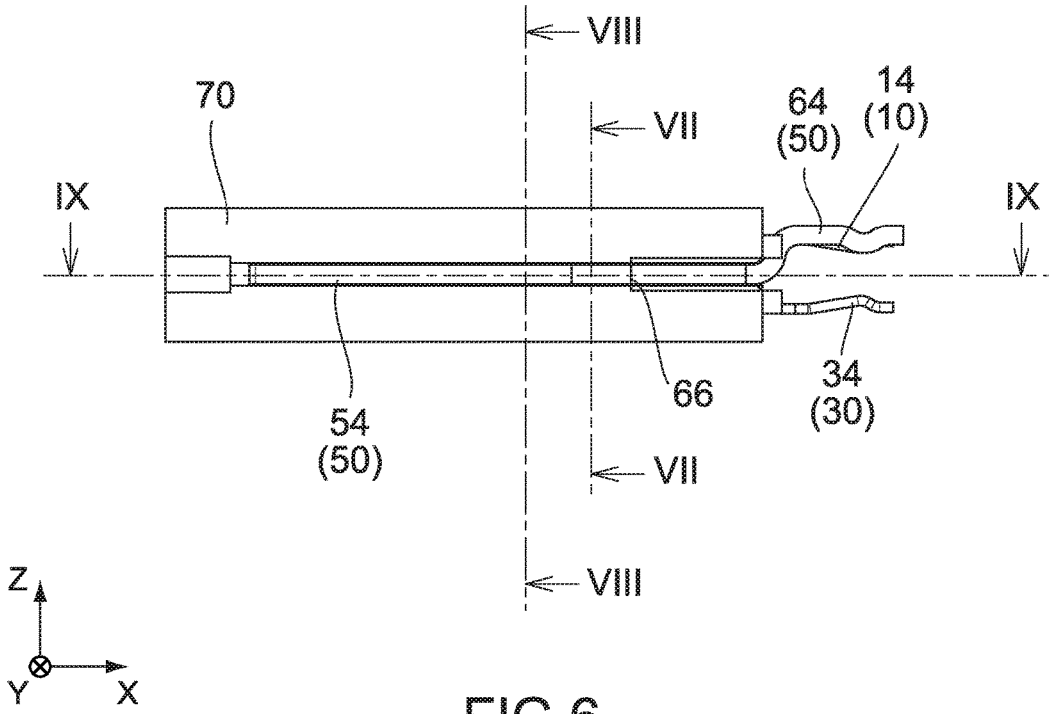
FIG. 6 is a side view showing a structure included in the connector of FIG. 1, wherein this structure does not include a shell and a front protection member of the connector.

Referring to FIG. 3, each of the first contacts 10 has a contact portion 12 and a terminal portion 14. The contact portion 12 is a part which is to be brought into contact with a mating contact (not shown) of the mating connector (not shown). As shown in FIGS. 1, 2 and 5, the terminal portion 14 is another part which is to be fixed and connected to the paddle board 5.

As shown in FIGS. 3, 4, 7 and 8, the first arrangement member 20 arranges the plurality of the first contacts 10 in the Y-direction (pitch direction) and holds the first contacts 10. In particular, the first contacts 10 of the present embodiment are partially embedded within the first arrangement member 20 via insert-molding when the first arrangement member 20 is formed. As can be seen from FIGS. 3 and 7, the first arrangement member 20 of the present embodiment is formed with two projections 22 each of which projects in the Z-direction (predetermined direction). Each of the projections 22 has a rectangular column shape.

As shown in FIG. 3, each of the second contacts 30 has a contact portion 32 and a terminal portions 34. The contact portion 32 is a part which is to be brought into contact with a mating contact (not shown) of the mating connector (not shown). As shown in FIG. 5, the terminal portions 34 is another part which is to be fixed and connected to the paddle board 5.

As shown in FIGS. 3, 4, 7 and 8, the second arrangement member 40 arranges the plurality of the second contacts 30 in the Y-direction and holds the second contacts 30. In particular, the second contacts 30 of the present embodiment are partially embedded within the second arrangement member 40 via insert-molding when the second arrangement member 40 is formed. As shown in FIGS. 3, 7, 9 and 10, the second arrangement member 40 of the present embodiment is formed with two projections 42 each of which projects in the Z-direction. Each of the projections 42 has a rectangular column shape.

As can be seen from FIG. 3, in the present embodiment, the first arrangement member 20 and the second arrangement member 40 have structures same as each other. Moreover, the first contact 10 and the second contact 30 have structures same as each other.

As can be seen from FIG. 3, the ground member 50 is formed by punching out a single metal plate. The ground member 50 of the present embodiment has a flat plate-like body portion 52, two lock springs 54 and a coupling portion 56. The illustrated ground member 50 is a member which integrates a so-called ground plate and lock springs. In particular, in the present embodiment, the body portion 52 and the lock springs 54 are positioned in the common XY-plane.

Figure 9:
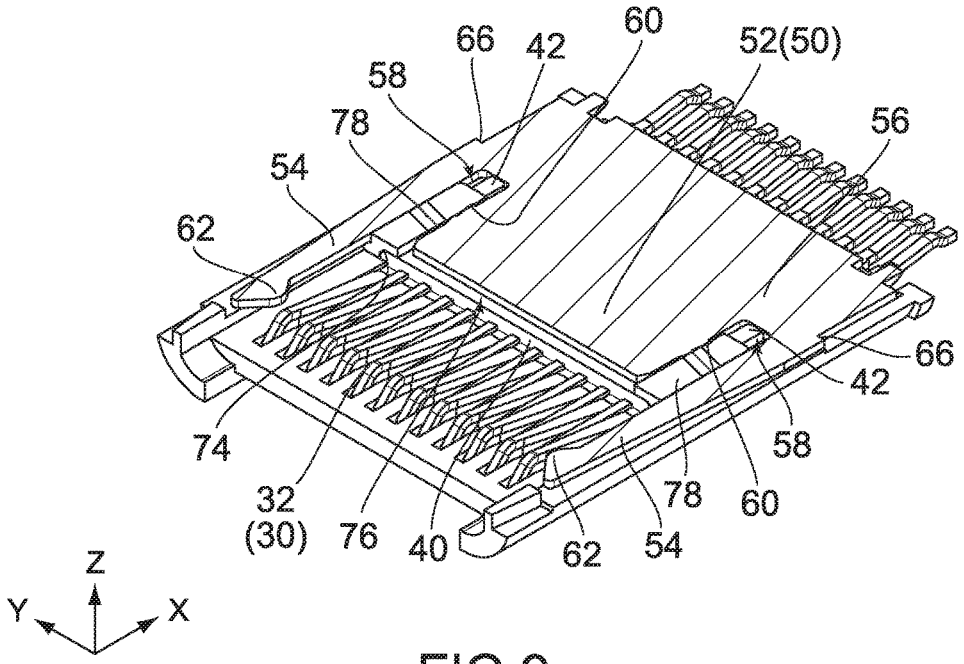
FIG. 9 is a partially cut-away, perspective view showing the structure of FIG. 6, taken along line IX-IX.
Figure 10:
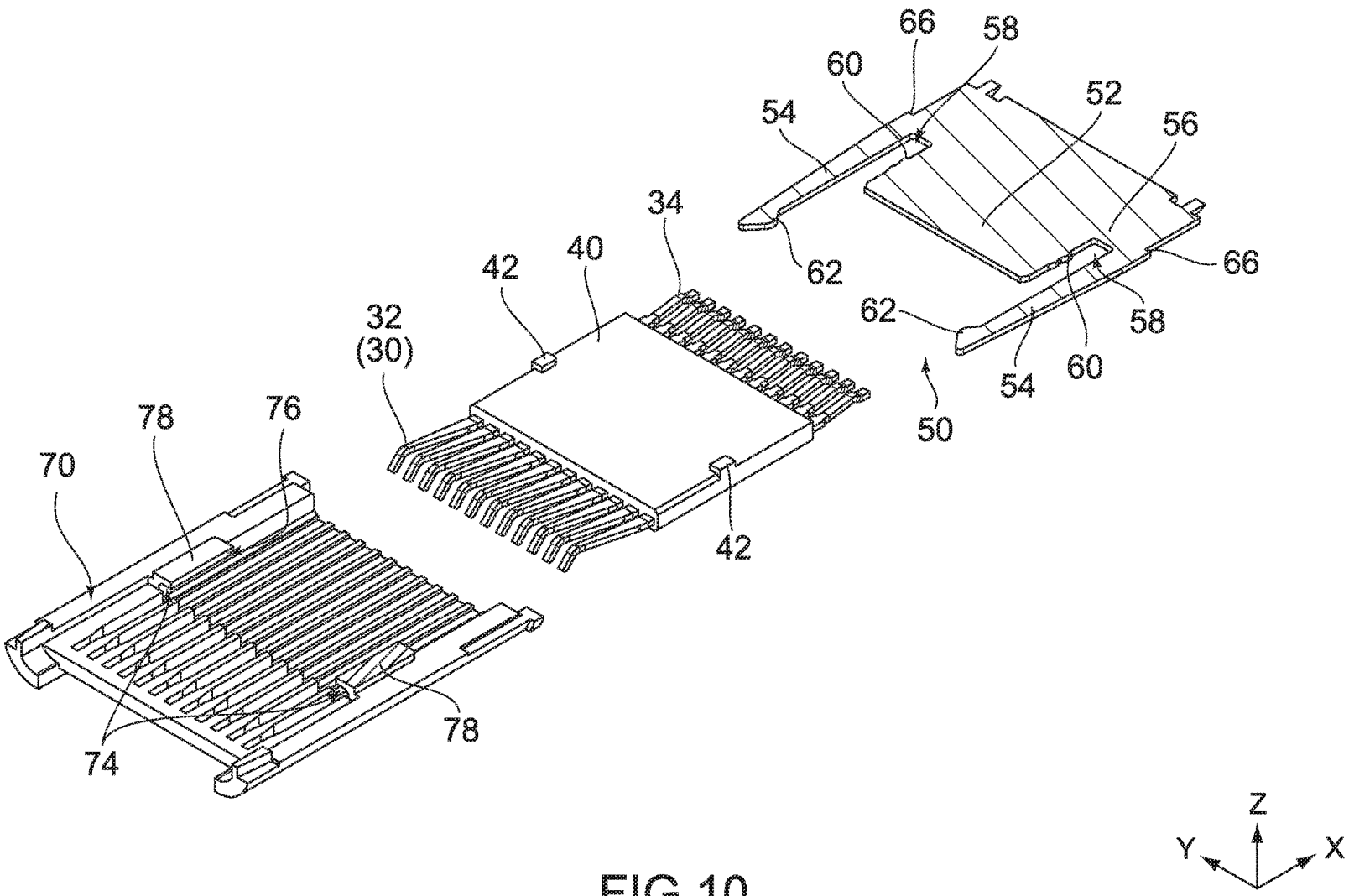
FIG. 10 is an exploded, perspective view showing the structure of FIG. 9.
Figure 11:
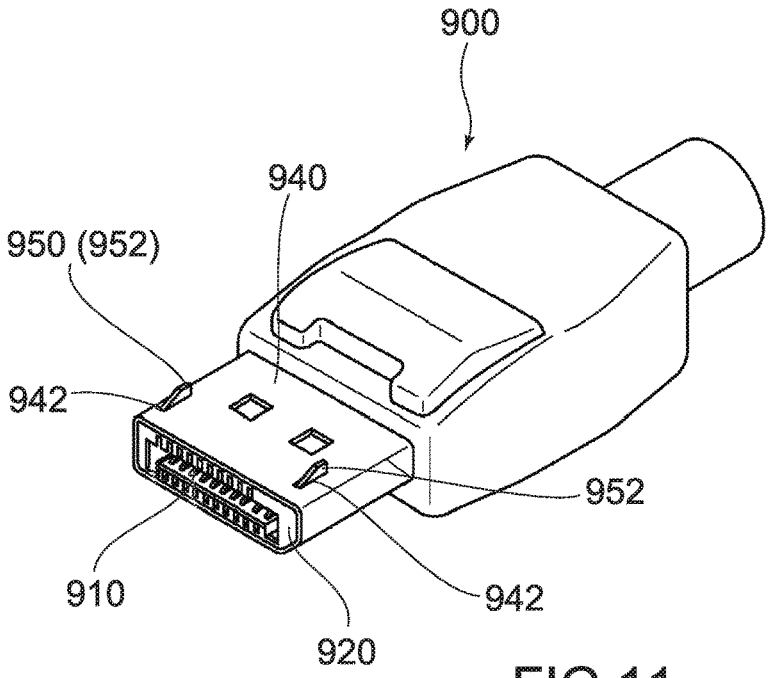
FIG.11 PRIOR ART
FIG. 11 is a perspective view showing a connector of Patent Document 1.

As shown in FIGS. 3 and 9, the body portion 52 is formed with a plurality of press-fit projections 60. The press-fit projections 60 project outward in the Y-direction from opposite edges of the body portion 52 in the Y-direction, respectively.

Each of the lock springs 54 is resiliently deformable in the XY-plane. Each of the lock springs 54 has a lock portion 62 which is to lock a locked portion (not shown) of the mating connector (not shown). Each of the lock portions 62 is movable in the XY-plane with use of resilience of the lock spring 54 thereof. In the present embodiment, the lock portions 62 of the two lock springs 54 are arranged to face each other in the Y-direction. In other words, each of the lock portions 62 is positioned in the XY-plane and projects inward in the Y-direction.

The coupling portion 56 couples the body portion 52 and each of the lock springs 54 to each other so as to form a gap 58 between the body portion 52 and each of the lock springs 54 in the Y-direction. Each of the press-fit projections 60 is positioned in either of the gaps 58. In other words, each of the press-fit projections 60 projects into either of the gaps 58.

Figure 12:
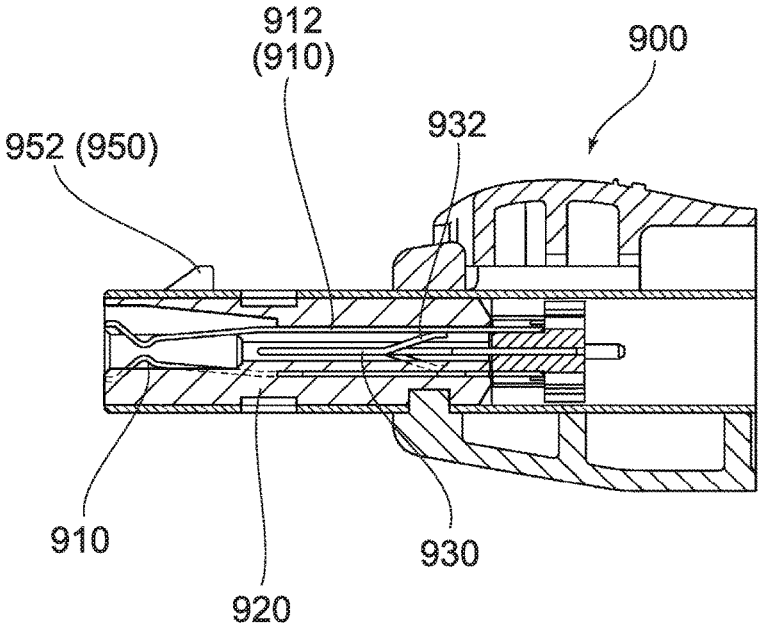
FIG.12 PRIOR ART
FIG. 12 is a cross-sectional view showing the connector of FIG. 11.
Figure 13:
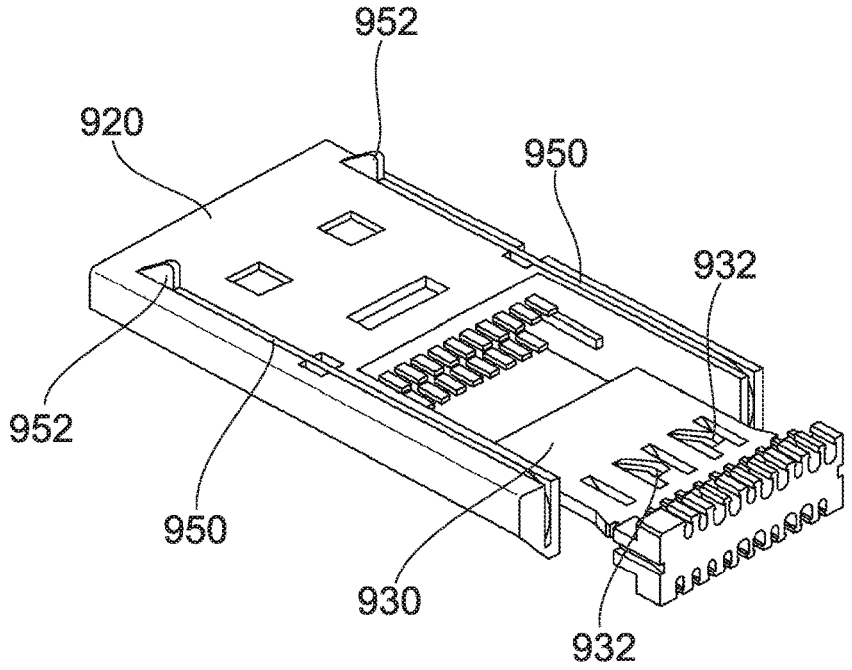
FIG.13 PRIOR ART
FIG. 13 is an exploded, perspective view showing a structure included in the connector of FIG. 11.

As shown in FIG. 3, the coupling portion 56 is formed with two ground terminal portions 64. The ground terminal portions 64 are positioned in the vicinities of opposite edges of the coupling portion 56 in the Y-direction, respectively, and extend from the positive X-side end of the coupling portion 56 in the positive X-direction. As shown in FIGS. 1, 2 and 5, the ground terminal portions 64 are to be fixed and connected on the paddle board 5 together with the terminal portions 14 of the first contacts 10. As can be seen from this structure, the ground member 50 is grounded via the ground terminal portions 64. Therefore, the ground member 50, unlike the ground plate 930 of Patent Document 1 (see FIG. 12), do not need to be in contact with a ground contact in the holding member 70. According to the present embodiment, since the body portion 52 is not required to be formed with an opening, shielding effect thereof can be prevented from being degraded. Moreover, the lock portions 62 and the locked portions (not shown) may be arranged so as to maintain a contact state therebetween under a state where the lock portions 62 lock the locked portions (not shown) of the mating connector (not shown). Under such arrangement, the ground member 50 can be also connected with the ground of the mating connector (not shown).

As shown in FIGS. 3 and 9, the coupling portion 56 is formed with steps 66 which are positioned at the opposite edges thereof in the Y-direction, respectively. The steps 66 are positioned in the vicinities of the lock springs 54, respectively.

Figure 7:
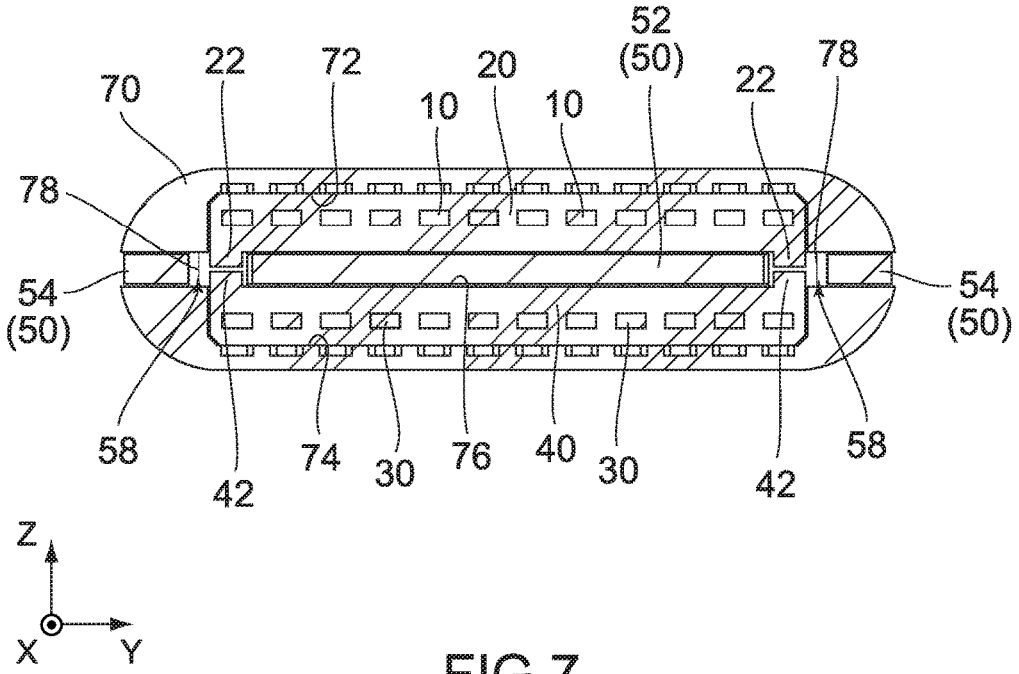
FIG. 7 is a cross-sectional view showing the structure of FIG. 6, taken along line VII-VII.
Figure 8:
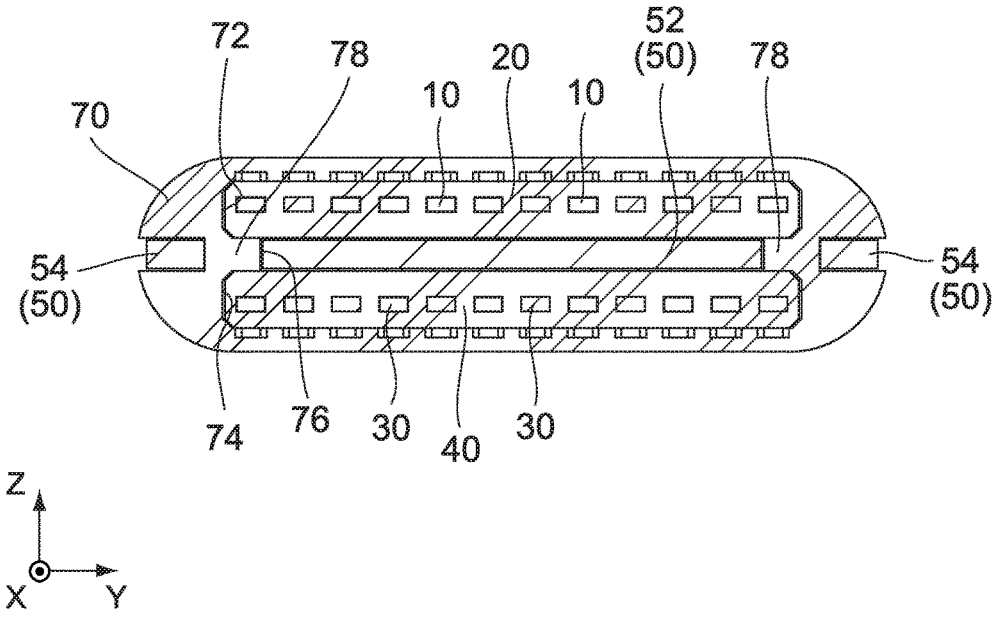
FIG. 8 is a cross-sectional view showing the structure of FIG. 6, taken along line VIII-VIII.

As shown in FIGS. 5, 7 and 8, the holding member 70 collectively holds the first arrangement member 20, the second arrangement member 40 and the ground member 50.

As shown in FIGS. 7 and 8, the holding member 70 is formed with a first accommodation portion 72 accommodating the first arrangement member 20 and a second accommodation portion 74 accommodating the second arrangement member 40. As shown in FIG. 8, the first accommodation portion 72 accommodates and holds the first arrangement member 20. The first accommodation portion 72 positions the thus-accommodated first arrangement member 20 in the Y-direction and the Z-direction. As shown in FIGS. 8 and 9, the second accommodation portion 74 accommodates and holds the second arrangement member 40. The second accommodation portion 74 positions the thus-accommodated second arrangement member 40 in the Y-direction and the Z-direction. In other words, the first accommodation portion 72 works as a Y-directional positioner (pitch-directional positioner) which positions the first arrangement member 20 in the Y-direction and works as a Z-directional positioner (predetermined-directional positioner) which positions the first arrangement member 20 in the Z-direction. Similarly, the second accommodation portion 74 works as another Y-directional positioner (pitch-directional positioner) which positions the second arrangement member 40 in the Y-direction and works as another Z-directional positioner (predetermined-directional positioner) which positions the second arrangement member 40 in the Z-direction.

As can be seen from FIGS. 7 and 8, the first accommodation portion 72 and the second accommodation portion 74 are formed to be in rotational symmetry with respect to a line passing a middle point which is middle of the holding member 70 in the Y-direction and middle of the holding member 70 in the Z-direction. Therefore, as can be seen from FIGS. 4, 7 and 8, the first arrangement member 20 accommodated in the first accommodation portion 72 and the second arrangement member 40 accommodated in the second accommodation portion 74 are arranged in rotational symmetry with respect to the line passing a middle point which is positioned middle of the first arrangement member 20 in the Y-direction, positioned middle of the second arrangement member 40 in the Y-direction, and positioned middle between the first arrangement member 20 and the second arrangement member 40 in the Z-direction.

As shown in FIG. 8, the first accommodation portion 72 and the second accommodation portion 74 are arranged to be apart from each other in the Z-direction. As a result, there is a space formed between the first accommodation portion 72 and the second accommodation portion 74. This space works as a central accommodation portion 76 which accommodates the body portion 52 of the ground member 50. Since the body portion 52 of the ground member 50 is accommodated in this central accommodation portion 76, the ground member 50 is positioned between the first arrangement member 20 and the second arrangement member 40 under a state where the first arrangement member 20, the second arrangement member 40 and the ground member 50 are held by the holding member 70.

As can be seen from FIGS. 8 and 9, the holding member 70 is provided with two positioning portions 78. The positioning portions 78 are formed at opposite sides of the central accommodation portion 76 in the Y-direction, respectively. As shown in FIG. 9, the press-fit projections 60 bite inner surfaces of the positioning portions 78 in the Y-direction, respectively, so that the ground member 50 is held by the holding member 70. In other words, the ground member 50 is press-fit into and fixed to the holding member 70.

As can be seen from FIGS. 7 and 9, the projections 22 of the first arrangement member 20 and the projections 42 of the second arrangement member 40 are positioned in the gaps 58 of the ground member 50 under a state where the first arrangement member 20, the second arrangement member 40 and the ground member 50 are held by the holding member 70. As shown in FIG. 7, in each of the gaps 58, the projection 22 and the projection 42 face each other in the Z-direction.

As can be seen from FIG. 9, in the Y-direction, a size (width) of the gap 58 is larger than each of a size (width) of the projection 22 and a size (width) of the projection 42. Moreover, as can be seen from FIGS. 7 and 9, in the Y-direction, a distance between the press-fit projection 60 and the lock spring 54 is larger than each of the size of the projection 22 and the size of the projection 42. In other words, each of the projection 22 and the projection 42 of the present embodiment has the size smaller than the distance between the press-fit projection 60 and the lock spring 54 in the Y-direction. Therefore, the ground member 50 can be press-fit into the holding member 70 from the positive X-side end portion of the holding member 70 toward the negative X-side after the first arrangement member 20 and the second arrangement member 40 are inserted into the holding member 70 from the positive X-side end portion of the holding member 70 toward the negative X-side and accommodated in the first accommodation portion 72 and the second accommodation portion 74, respectively. According to the present embodiment, since the size of the projection 22 and the size of the projection 42 are designed as described above, every one of the first arrangement member 20, the second arrangement member 40 and the ground member 50 can be inserted into the holding member 70 along the negative X-direction. Thus, the structure of the present embodiment is suitable to automation in assembly of connector. However, the present invention is not limited thereto. For example, the first arrangement member 20, the second arrangement member 40 and the ground member 50 may be integrally accommodated in the holding member 70 after the ground member 50 is sandwiched between the first arrangement member 20 and the second arrangement member 40. In this case, the size of each of the projection 22 and the projection 42 in the Y-direction may be larger than the size according to the present embodiment, provided that the projection 22 and the projection 42 can be accommodated in the gap 58.

As can be seen from FIG. 9, the positioning portions 78 are positioned in the gaps 58 in the Y-direction, respectively, under the state where the first arrangement member 20, the second arrangement member 40 and the ground member 50 are held by the holding member 70. As can be seen from FIGS. 7 and 9, the projection 22 of the first arrangement member 20 and the projection 42 of the second arrangement member 40 are positioned between the positioning portion 78 and the coupling portion 56 in the X-direction. In particular, in the present embodiment, the projection 22 of the first arrangement member 20 and the projection 42 of the second arrangement member 40 are sandwiched by the positioning portion 78 and the coupling portion 56 in the X-direction. As a result, the first arrangement member 20 and the second arrangement member 40 are positioned in the X-direction relative to the ground member 50.

As can be seen from FIGS. 2 and 5, the shell 80 partially covers the holding member 70. The shell 80 is formed with claw portions 82. After the members including the holding member 70 are accommodated in the shell 80, the claw portions 82 are bent inward in the Y-direction so that the shell 80 is fixed to the holding member 70. At that time, as can be seen from FIGS. 2 and 9, ends of the claw portions 82 are positioned toward the positive X-sides of the steps 66, respectively, and face the steps 66 in the X-direction, respectively. This arrangement prevents the holding member 70 and the ground member 50 from being removed from the shell 80.

The present invention is not limited to the aforementioned specification bur can be variously modified as described below.

Although the first contacts 10 according to the aforementioned embodiment are embedded in the first arrangement member 20 via insert-molding, the present invention is not limited thereto. For example, the first contacts 10 may be held by the first arrangement member 20 via another method such as press-fitting. Similarly, the second contacts 30 may be held by the second arrangement member 40 via another method such as press-fitting.

Although each of the press-fit projections 60 according to the aforementioned embodiment is provided to the body portion 52 and projects into either of the gaps 58, the present invention is not limited thereto. For example, the press-fit projections 60 may be formed on the opposite edges of the coupling portion 56 in the Y-direction, respectively. However, a size of the holding member 70 according to this modification might become large. Therefore, each of the press-fit projections 60 is preferred to project into either of the gaps 58.

Although the projection 22 and the projection 42 according to the aforementioned embodiment are formed on the first arrangement member 20 and the second arrangement member 40, respectively, the present invention is not limited thereto. For example, only one of the first arrangement member 20 and the second arrangement member 40 may be formed with a relatively long projection. In this modification, a remaining one of the first arrangement member 20 and the second arrangement member 40 may be formed with a hole which receives an end of this projection.

The present application is based on a Japanese patent application of JP2014-056055 filed before the Japan Patent Office on Mar. 19, 2014, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

1 connector
5 paddle board (object)
10 first contact
12 contact portion
14 terminal portion
20 first arrangement member
22 projection
30 second contact
32 contact portion
34 terminal portion
40 second arrangement member
42 projection
50 ground member
52 body portion
54 lock spring
56 coupling portion
58 gap
60 press-fit projection
62 lock portion
64 ground terminal portion
66 step
70 holding member
72 first accommodation portion (pitch-directional positioner, predetermined-directional positioner)
74 second accommodation portion (pitch-directional positioner, predetermined-directional positioner)
76 central accommodation portion
78 positioning portion
80 shell
82 claw portion
90 front protection member
900 connector
910 contact
912 ground contact
920 holding member
930 ground plate
932 spring portion
940 shell
942 opening
950 lock member
952 lock portion

The invention claimed is:

1. A connector mateable with a mating connector along a mating direction, wherein:

the connector comprises a first arrangement member, a second arrangement member, a plurality of first contacts, a plurality of second contacts, a ground member and a holding member;

the first arrangement member arranges the first contacts in a pitch direction perpendicular to the mating direction and holds the first contacts;

the second arrangement member arranges the second contacts in the pitch direction and holds the second contacts;

the ground member has a flat plate-like body portion, a lock spring and a coupling portion;

the lock spring has a lock portion which is configured to lock a locked portion of the mating connector;

the coupling portion couples the body portion and the lock portion to each other;

the holding member collectively holds the first arrangement member, the second arrangement member and the ground member so that the body portion of the ground member is positioned between the first arrangement member and the second arrangement member;

an upper surface of the body portion and an upper surface of the lock spring are positioned in a common plane; and the lock spring is resiliently deformable in the plane.

2. The connector as recited in claim 1, wherein:

at least one of the first arrangement member and the second arrangement member is formed with a projection which projects in a predetermined direction perpendicular to both the mating direction and the pitch direction;

the coupling portion couples the body portion and the lock portion to each other so as to form a gap between the body portion and the lock portion;

the holding member is provided with a positioning portion;

the positioning portion is positioned in the gap in the pitch direction; and the projection of the at least one of the first arrangement member and the second arrangement member is positioned between the positioning portion and the coupling portion in the mating direction.

3. The connector as recited in claim 2, wherein:

each of the first arrangement member and the second arrangement member is formed with the projection; and the projection of the first arrangement member and the projection of the second arrangement member face each other in the gap in the predetermined direction.

4. The connector as recited in claim 2, wherein the projection has a rectangular column shape.

5. The connector as recited in claim 1, wherein:

the ground member is formed with a press-fit projection; and the ground member is press-fit into and fixed to the holding member.

6. The connector as recited in claim 2, wherein:

the ground member is formed with a press-fit projection;

the press-fit projection projects into the gap from the body portion; and the ground member is press-fit into and fixed to the holding member.

7. The connector as recited in claim 6, wherein the projection has a width smaller than a distance between an outermost point of the press-fit projection and an inner edge of the lock spring in the pitch direction.

8. The connector as recited in claim 1, wherein the lock portion projects inward in the pitch direction in the plane.

9. The connector as recited in claim 1, wherein:

the first arrangement member and the second arrangement member have structures same as each other;

the holding member is provided with a first accommodation portion accommodating the first arrangement member and a second accommodation portion accommodating the second arrangement member; and the first accommodation portion and the second accommodation portion are formed to be in rotational symmetry with respect to a line passing a middle point which is at a middle of the holding member in the pitch direction and at a middle of the holding member in a predetermined direction perpendicular to both the mating direction and the pitch direction.

10. The connector as recited in claim 1, wherein:

each of the first contacts and the second contacts has a terminal portion which is to be fixed and connected to an object; and the ground member has a ground terminal portion which is to be fixed and connected to the object.

11. The connector as recited in claim 1, wherein the holding member has a pitch-directional positioner which positions the first arrangement member and the second arrangement member in the pitch direction.

12. The connector as recited in claim 1, wherein the holding member has a predetermined-directional positioner which positions the first arrangement member and the second arrangement member in a predetermined direction perpendicular to both the mating direction and the pitch direction.

13. The connector as recited in claim 1, wherein the connector comprises a shell which covers, at least in part, the holding member.

14. The connector as recited in claim 13, wherein:

the shell is formed with a claw portion;

the ground member is formed with a step; and an end of the claw portion is arranged to face the step in the mating direction.

15. A connector mateable with a mating connector along a mating direction, wherein:

the connector comprises a first arrangement member, a second arrangement member, a plurality of first contacts, a plurality of second contacts, a ground member and a holding member;

the first arrangement member arranges the first contacts in a pitch direction perpendicular to the mating direction and holds the first contacts;

the second arrangement member arranges the second contacts in the pitch direction and holds the second contacts;

the ground member has a flat plate-like body portion, a lock spring and a coupling portion;

the lock spring has a lock portion which is configured to lock a locked portion of the mating connector;

the coupling portion couples the body portion and the lock portion to each other;

the holding member collectively holds the first arrangement member, the second arrangement member and the ground member so that the body portion of the ground member is positioned between the first arrangement member and the second arrangement member;

at least one of the first arrangement member and the second arrangement member is formed with a projection which projects in a predetermined direction perpendicular to both the mating direction and the pitch direction;

the coupling portion couples the body portion and the lock portion to each other so as to form a gap between the body portion and the lock portion;

the holding member is provided with a positioning portion;

the positioning portion is positioned in the gap in the pitch direction; and the projection of the at least one of the first arrangement member and the second arrangement member is positioned between the positioning portion and the coupling portion in the mating direction.

16. A connector mateable with a mating connector along a mating direction, wherein:

the connector comprises a first arrangement member, a second arrangement member, a plurality of first contacts, a plurality of second contacts, a ground member and a holding member;

the first arrangement member arranges the first contacts in a pitch direction perpendicular to the mating direction and holds the first contacts;

the second arrangement member arranges the second contacts in the pitch direction and holds the second contacts;

the ground member has a flat plate-like body portion, a lock spring and a coupling portion;

the lock spring has a lock portion which is configured to lock a locked portion of the mating connector;

the coupling portion couples the body portion and the lock portion to each other;

the holding member collectively holds the first arrangement member, the second arrangement member and the ground member so that the body portion of the ground member is positioned between the first arrangement member and the second arrangement member;

the connector comprises a shell which covers, at least in part, the holding member;

the shell is formed with a claw portion;

the ground member is formed with a step; and an end of the claw portion is arranged to face the step in the mating direction.

* * * * *